US006390440B1

(12) United States Patent
Morin

(10) Patent No.: US 6,390,440 B1
(45) Date of Patent: May 21, 2002

(54) FOOTING FRAME LOCKING DEVICE

(76) Inventor: Kenneth Morin, 236 Boston Post Rd., Madison, CT (US) 06443

( * ) Notice: Subject to any disclaimer, the term of this patent is extended or adjusted under 35 U.S.C. 154(b) by 0 days.

(21) Appl. No.: 09/678,822

(22) Filed: Oct. 4, 2000

(51) Int. Cl.[7] ..... E04G 17/04

(52) U.S. Cl. ..... 249/219.1; 249/34; 249/38; 249/4

(58) Field of Search ..... 249/219.1, 34, 249/38, 4

(56) References Cited

U.S. PATENT DOCUMENTS

| | | | | | |
|---|---|---|---|---|---|
| 799,914 | A | | 9/1905 | Merriett | |
| 1,816,921 | A | | 8/1931 | Urschel | |
| 2,535,277 | A | | 12/1950 | Fama | |
| 2,788,560 | A | | 4/1957 | de Boisblanc | |
| 3,207,465 | A | * | 9/1965 | Papin | 249/219 |
| 3,687,411 | A | | 8/1972 | Frazier | |
| 3,778,020 | A | * | 12/1973 | Burrows et al. | 249/219 |
| 4,029,288 | A | * | 6/1977 | Murphy et al. | 249/216 |
| 4,339,106 | A | * | 7/1982 | Navarro | 249/219 |
| 4,494,725 | A | * | 1/1985 | Sims | 249/219 |
| 4,915,345 | A | | 4/1990 | Lehmann | |
| 5,048,781 | A | * | 9/1991 | Breen | 249/219 |
| 5,156,753 | A | * | 10/1992 | Speidel | 249/5 |
| 5,205,942 | A | * | 4/1993 | Fitzgerald | 249/3 |
| 5,207,931 | A | * | 5/1993 | Porter | 249/210 |

* cited by examiner

*Primary Examiner*—Carl D. Friedman
*Assistant Examiner*—Dennis L. Dorsey
(74) *Attorney, Agent, or Firm*—Alix, Yale & Ristas, LLP

(57) ABSTRACT

A locking device for use with a concrete framing structure having a plurality of frame panels which form opposed first and second sides. The locking device includes a first locking half having a first mounting member and a first clamping member mounted to the first mounting member and a second locking half having a second mounting member and a second clamping member mounted to the second mounting member. The first mounting member rigidly holds one of the frame panels of the first side of the concrete forming structure and the second mounting member rigidly holds the opposite frame panel of the second side of the concrete forming structure. The locking device also includes means for clamping the first clamping member to the second clamping member such that the first mounting member is locked at a predetermined distance from the second mounting member.

18 Claims, 4 Drawing Sheets

FOOTING FRAME LOCKING DEVICE

BACKGROUND OF THE INVENTION

This invention relates generally to concrete forming structures. More particularly, the present invention relates to apparatus for interlocking forms utilized in molding concrete footings.

Reusable, multi-paneled forms are usually used for molding concrete structures such as footings. Such forms generally require additional elements with which to interlock the opposed panels such that the sides of the form are rigidly locked at a predetermined distance which defines the width of the footing. Conventional locking devices commonly require insertion of portions of a rod through complementary openings in the panels. Use of these locking devices requires aligning the complementary openings, a procedure which can be time consuming. Further, the rod generally have a fixed length and therefore provide no flexibility with respect to setting the width of the footing.

SUMMARY OF THE INVENTION

Briefly stated, the invention in a preferred form is a locking device for use with a concrete framing structure having a plurality of frame panels which form opposed first and second sides. The locking device includes a first locking half having a first mounting member and a first clamping member mounted to the first mounting member and a second locking half having a second mounting member and a second clamping member mounted to the second mounting member. The first mounting member rigidly holds one of the frame panels of the first side of the concrete forming structure and the second mounting member rigidly holds the opposite frame panel of the second side of the concrete forming structure. The locking device also includes means for clamping the first clamping member to the second clamping member such that the first mounting member is locked at a predetermined distance from the second mounting member.

The first and second mounting members each include a side mounting portion which is mounted to the side of a frame panel and a top mounting portion which extends perpendicular to the side mounting portion and is mounted to the top of a frame panel. At least one aperture is provided in the side and top mounting portions of each mounting member. A fastener extends through at least one of the apertures in each of the side and top mounting portions to mount the mounting member to the frame panel.

The first and second clamping members each include a mounting segment and a clamping segment which extends perpendicular to the mounting segment. The mounting segment of the first clamping member is mounted to the side mounting portion of the first mounting member and the mounting segment of the second clamping member is mounted to the side mounting portion of the second mounting member such that the clamping segments are longitudinally spaced from the top mounting portions of the mounting members.

The clamping means is a bolt member having an operator, a threaded shaft and an end. The clamping segments of the first and second clamping members each have a bore, with at least a portion of the clamping segment of the second clamping member being disposed within the bore of the clamping segment of the first clamping member. The clamping segment of the first clamping member has an opening extending transversely into the bore and includes a nut having a threaded opening which is coaxial with the opening of the clamping segment. The threaded shaft of the bolt member is threadably engaged with the threaded opening of the nut, such that the end of the bolt member is positionable within the bore of the clamping segment of the first clamping member to engage the clamping segment of the second clamping member.

It is an object of the invention to provide a new and improved device for locking the sides of a footing form in place.

It is also an object of the invention to provide a footing frame locking device which is easier to install than conventional devices.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENTS

Figure 1:
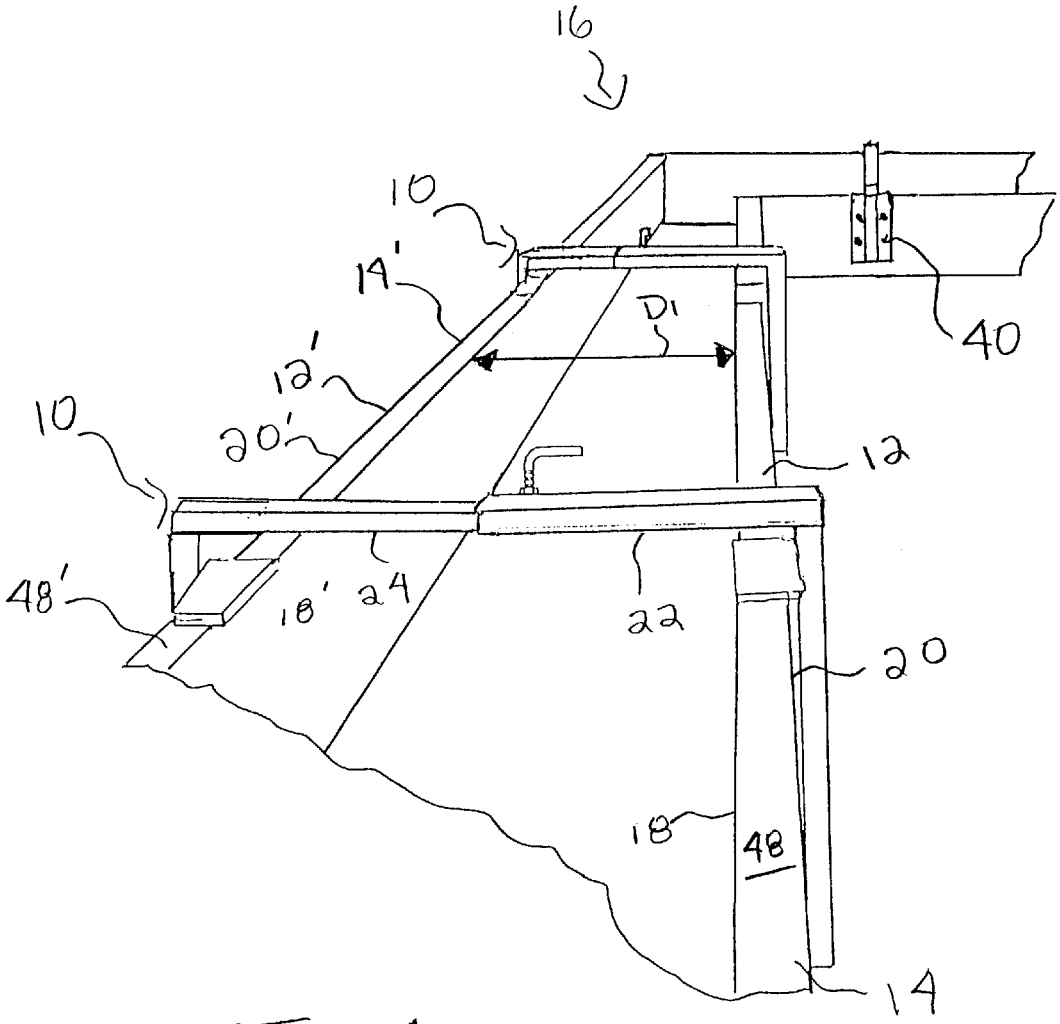
FIG. 1 is a perspective view of a footing frame having a footing frame locking device in accordance with the invention.

With reference to the drawings wherein like numerals represent like parts throughout the several figures, a footing frame locking device in accordance with the present invention is generally designated by the numeral 10. With reference to FIG. 1, a number of frame panels 12, 12' are arranged in coplanar array to define each side 14, 14' of the form 16. Usually, the two sides 14, 14' are positioned as substantially parallel rows to partially enclose a space at the position where the concrete footing is to be located. Each frame panel 12, 12' has an inner side 18, 18' which faces the inner side 18', 18 of a frame panel 12', 12 in the other row and an oppositely disposed outer side 20, 20'. The inner sides 18, 18' of the frame panels 12, 12' and the ground disposed therebetween define the footing form, with the distance D1 between the inner sides 18, 18' defining the thickness of the footing. The frame panels 12, 12' are usually manufactured from wood in the form of wood planks or plywood since such materials are relatively inexpensive, may be easily cut to size or joined together, may generally be reused a number of times, and is easily disposed of at the end of its useful life.

Figure 2:
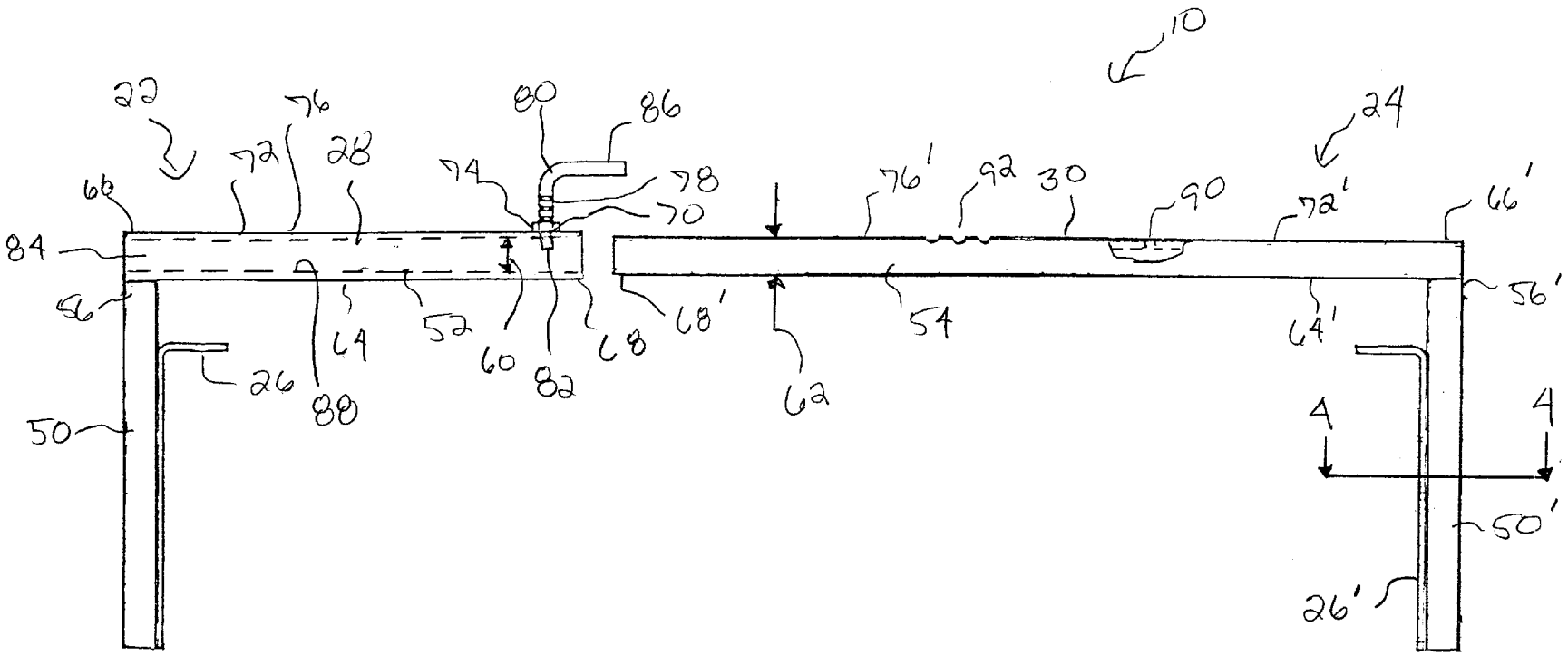
FIG. 2 is an exploded front view, partly in phantom of the footing frame locking device of FIG. 1.

The opposed sides 14, 14' are rigidly locked in place at the proper distance D1 by one or more locking devices 10. Each locking device 10 includes first and second locking halves 22, 24 with the first locking half 22 including a first mounting member 26 and a first clamping member 28 and the second locking half 24 including a second mounting member 26' and a second clamping member 30 (FIG. 2). The number of locking devices 10 which are required for a footing form 16 is dependent on several factors including the length and height of the footing form 16 and the weight of the concrete that will be poured into the footing form 16.

Figure 5:
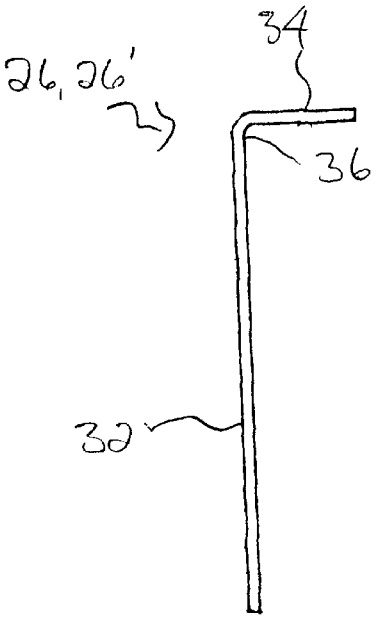
FIG. 5 is front view of the mounting member of FIG. 1.
Figure 6:
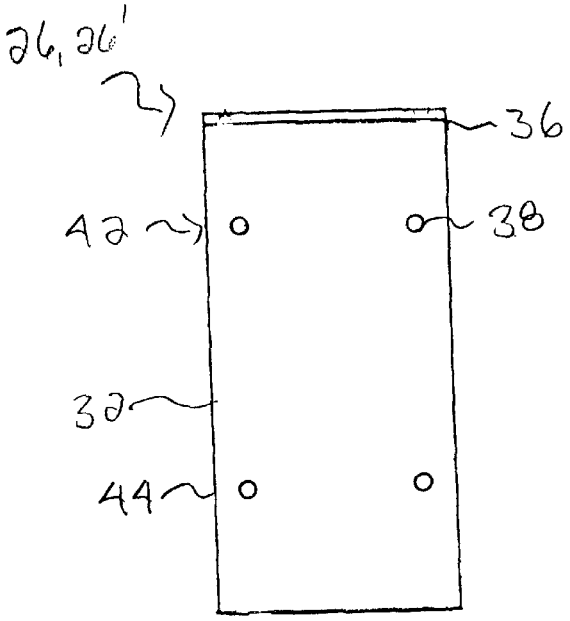
FIG. 6 is side view of the mounting member of FIG. 1.
Figure 7:
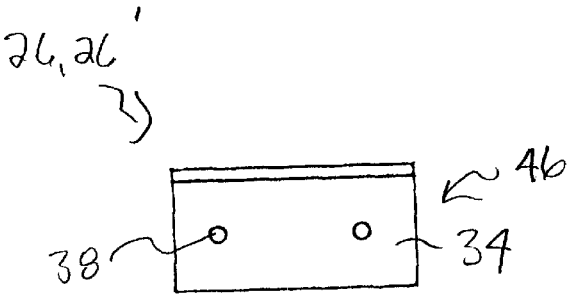
FIG. 7 is top view of the mounting member of FIG. 1.

With reference to FIGS. 5, 6, and 7, the first and second mounting members 26, 26' are substantially identical, each having a vertical, side mounting portion 32 and a horizontal, top mounting portion 34 which extends perpendicularly from the top end portion 36 of the side mounting portion 32. The mounting members 26, 26' are preferably manufactured from 3/16 inch thick steel plate. The side and top mounting portions 32, 34 each have at least one aperture 38. A fastener 40, such as a nail or a screw, is inserted through each of the apertures 38 into the wood material of the frame panel 12, 12' to rigidly mount the mounting member 26, 26', and the associated locking half 22, 24, to a side 14, 14' of the form 16.

It should be appreciated that the dimensions of the side and top mounting portions 32, 34 and the number and positions of the apertures 38 is dependent on the dimensions of the wood material from which the frame panel 12, 12' is manufactured. For example, if a 2×12 wood plank is used to manufacture the frame panels 12, 12', the side and top mounting portions 32, 34 will preferably have dimensions of 8¼ inches by 4 inches and 2 inches by 4 inches, respectively. Preferably, the side mounting portion 32 would have an upper pair 42 of laterally spaced apertures 38 and a lower pair 44 of laterally spaced apertures 38 and the top mounting portion 34 would have a single pair 46 of laterally spaced apertures 38.

The first mounting member 26 is mounted to the first side 14 by positioning the side and top mounting portions 32, 34 adjacent the outer side 20 and top 48, respectively, of one of the frame panels 12 and inserting a fastener 40 through each of the apertures 38 and into the wood material of the frame panel 12. The second mounting member 26' is mounted to the second side 14' by positioning the side and top mounting portions 32, 34 adjacent the outer side 20' and top 48', respectively, of the frame panel 12' which is opposite to the frame panel 12 to which the first mounting member 26 is mounted and inserting a similar fastener 40 through each of the apertures 38 into the wood material of the frame panel 12'.

Figure 3:
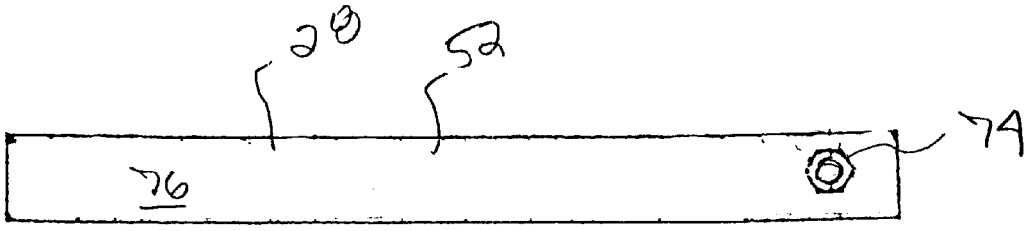
FIG. 3 is top view of the receiving portion of the clamp member of the footing frame locking device of FIG. 1.
Figure 4:
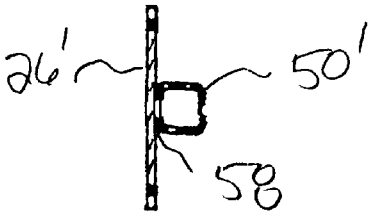
FIG. 4 is section view taken along line 4—4 of FIG. 2.

With reference to FIGS. 2 and 3, the first and second clamping members 28, 30 each include a vertical, mounting segment 50, 50' and a horizontal, clamping segment 52, 54 which extends perpendicularly from the top end portion 56, 56' of the mounting segment 50, 50'. The mounting segments 50, 50' of the first and second clamping members 28, 30 are fixedly mounted to the side mounting portions 32 of the first and second mounting members 26, 26', respectively, such that the clamping segment 52, 54 of the clamping member 28, 30 is longitudinally spaced from the top mounting portion 34 of the mounting member 26, 26'. The gap between the clamping segment 52, 54 and the top mounting portion 34 provides greater access to the apertures 38 in the top mounting portion 34 to facilitate mounting the mounting member 26, 26' to a frame panel 12, 12'. The mounting segment 50, 50' of the clamping member 28, 30 may be mounted to the side mounting portion 32 of the mounting member 26, 26' by one or more welds 58 or by mechanical means such as rivets, bolts, screws, etc. It should be appreciated that the apertures 38 in the side mounting portions 32 are positioned on either side of the mounting segment 50, 50'.

The first and second clamping members 28, 30 are each manufactured from tubular steel, with the inside diameter 60 of the clamping segment 52 of the first clamping member 28 being greater than the outside diameter 62 of the clamping segment 54 of the second clamping member 30. Preferably, the tubular steel has a rectangular cross section although tubular steel having a circular cross section may be used. The plane of engagement provided by rectangular tubular steel provides a superior means of mounting the clamping member 28, 30 to the mounting member 26, 26' than the line of engagement provided by circular tubular steel. In a preferred embodiment, the first clamping member 28 is manufactured from 1¼ inch by 1¼ inch, fourteen gauge tubular steel and the second clamping member 30 is manufactured from 1 inch by 1 inch, twelve gauge tubular steel. Preferably, each clamping member 28, 30 is manufactured by welding the upper end 56, 56' of the mounting segment 50, 50' to the lower surface 64, 64' of the outboard end portion 66, 66' of the clamping segment 52, 54. Such construction is less susceptible to flexure. Alternatively, the clamping member 28, 30 may be manufactured by bending a single piece of tubular steel to form vertical and horizontal segments or by mechanically joining the mounting segment to the clamping segment.

The inboard end portion 68 of the clamping segment 52 of the first clamping member 28 has an opening 70 extending through the upper wall 72 of the tube. Preferably, a nut 74 is welded to the upper surface 76 of the upper wall 72 such that opening 70 and the threaded opening of the nut 74 are coaxial. Alternatively, the inner surface of opening 70 may be threaded. The threaded shaft 78 of a bolt member 80 is received in the threaded opening of nut 74 or threaded opening 70 such that the end 82 of the bolt member 80 is threadably positionable within the bore 84 of the clamping member 52. In a preferred embodiment, the bolt member 80 includes a threaded shaft 78 and an operator 86 which extends substantially orthogonally from the threaded shaft 78. The length of the operator 86 is selected such that it may easily be grasped within the installer' hand. Alternatively, a conventional bolt may be used.

The design of the locking device 10 provides a great deal of flexibility in the manner in which the footing form 16 is installed, depending on the preferences of the installer and the particular requirements and conditions of each installation. For example, the footing form 16 may be installed by assembling the first and second sides 14, 14' of frame panels 12,12' at the location where the footing is to be formed. The first mounting member 26 of a locking device 10 is mounted to one of the frame panels 12 in the first side 14 of frame panels with fasteners 40, as described above. Next, the end 82 of the bolt member 80 is positioned substantially flush with the inner surface 88 of the upper wall 72 of the clamping segment 52 of the first clamping member 28 and the inboard end portion 68' of the clamping segment 54 of the second clamping member 30 is inserted into the bore 84 of the clamping segment 52 of the first clamping member 28 until the second mounting member 26' is positioned adjacent to a frame panel 12' in the second side 14' of frame panels. The second mounting member 26' is then mounted to this frame panel 12', as described above. After all of the locking devices 10 are mounted in this manner, the positions of the first and second sides 14, 14' of frame panels 12, 12' is verified and adjusted as necessary and the bolt member 80 of each locking device 10 is torqued until the end 82 of the bolt member 80 engages the upper surface 76' of the clamping segment 54 of the second clamping member 30 to clamp it within the clamping segment 52 of the first clamping member 28 and lock the second locking half 24 in position relative to the first locking half 22.

It should be appreciated that the locking halves 22, 24 may be joined together before either mounting member 26, 26' is mounted to a frame panel 12, 12' and that both mounting members 26, 26' may be mounted to a frame panel 12, 12' before the locking halves 22, 24 are joined. It should also be appreciated that locking the relative positions of the first and second mounting members 26, 26' also locks the relative positions of the first and second sides 14, 14' of frame panels 12, 12', which are mounted to the locking devices 10.

While preferred embodiments have been shown and described, various modifications and substitutions may be made thereto without departing from the spirit and scope of the invention. For example, the upper wall 72' of the clamping segment 54 of the second clamping member 30 may have openings 90 or indentations 92 in its upper surface 76' at least partially receiving the end 82 the bolt member 80 and thereby provide a more secure locking arrangement. Accordingly, it is to be understood that the present invention has been described by way of illustration and not limitation.

What is claimed is:

1. A locking device for use with a concrete framing structure having a plurality of frame panels forming opposed first and second sides, each of the frame panels having a side and a top, the locking device comprising:

a first locking half including a first mounting member and a first clamping member mounted to the first mounting member, the first mounting member being adapted for rigidly holding one of the frame panels of the first side of the concrete forming structure, the first mounting member having a side mounting portion adapted for mounting to the side of a frame panel and a top mounting portion adapted for mounting to the top of a frame panel, the top mounting portion extending substantially perpendicular to the side mounting portion;

a second locking half including a second mounting member and a second clamping member mounted to the second mounting member, the second mounting member being adapted for rigidly holding one of the frame panels of the second side of the concrete forming structure, the second mounting member having a side mounting portion adapted for mounting to the side of a frame panel and a top mounting portion adapted for mounting to the top of a frame panel, the top mounting portion extending substantially perpendicular to the side mounting portion; and clamping means for clamping the first clamping member to the second clamping member;

wherein the first mounting member is locked at a predetermined distance from the second mounting member.

2. The locking device of claim 1 wherein the side and top mounting portions of each mounting member each define at least one aperture and the locking device further comprises a plurality of fasteners, each of the fasteners being adapted for extending through one of the apertures to engage a frame panel.

3. The locking device of claim 1 wherein the first and second clamping members each comprise a mounting segment and a clamping segment extending substantially perpendicular to the mounting segment, the mounting segment of the first clamping member being mounted to the side mounting portion of the first mounting member and the mounting segment of the second clamping member being mounted to the side mounting portion of the second mounting member.

4. The locking device of claim 3 wherein the clamping segments of the first and second clamping members are each longitudinally spaced from the top mounting portions of the first and second mounting members, respectively.

5. The locking device of claim 1 wherein the first and second clamping members are each composed of tubular steel.

6. The locking device of claim 5 wherein the clamping segments of the first and second clamping members each have an inside diameter and an outside diameter, the inside diameter of the clamping segment of the first clamping member being greater than the outside diameter of the clamping segment of the second clamping member.

7. The locking device of claim 6 wherein the clamping means comprises a bolt member having a threaded shaft and an end, the clamping segment of the first clamping member defines an opening receiving the threaded shaft of the bolt member, and at least a portion of the clamping segment of the second clamping member is disposed within the clamping segment of the first clamping member, the end of the bolt member being threadably positionable within the first clamping member to clamp the clamping segment of the second clamping member therein.

8. The locking device of claim 7 wherein the first clamping member further has a nut mounted to the clamping segment, the nut defining a threaded opening which is coaxial with the opening of the clamping segment, the threaded shaft of the bolt member being threadably engaged with the threaded opening of the nut.

9. The locking device of claim 7 wherein the bolt member also has a operator extending substantially orthogonally from the threaded shaft.

10. A concrete framing structure comprising:

a plurality of frame panels forming at least one set of opposed first and second sides, each of the frame panels having inner and outer sides and a top, the inner sides of the frame panels of the first side facing the inner sides of the frame panels of the second side at a predetermined distance; and at least one locking device, each of the locking devices comprising a first locking half including a first mounting member and a first clamping member mounted to the first mounting member, the first mounting member rigidly holding one of the frame panels of the first side, the first mounting member having a side mounting portion and a top mounting portion extending substantially perpendicular to the side mounting portion, the side mounting portion being mounted to the outer side of the frame panel of the first side and the top mounting portion being mounted to the top of the frame panel of the first side, a second locking half including a second mounting member and a second clamping member mounted to the second mounting member, the second mounting member rigidly holding a frame panel of the second side which is opposite the one frame panel of the first side, the second mounting member having a side mounting portion and a top mounting portion extending substantially perpendicular to the side mounting portion, the side mounting portion being mounted to the outer side of the frame panel of the second side and the top mounting portion being mounted to the top of the frame panel of the second side, and clamping means for clamping the first clamping member to the second clamping member;

wherein the inner sides of the frame panels of the first side are locked at the predetermined distance from the inner sides of the frame panels of the second side.

11. The framing structure of claim 10 wherein the side and top mounting portions of each mounting member each define at least one aperture and the locking device further comprises a plurality of fasteners, each of the fasteners extending through one of the apertures and engaging the frame panel.

12. The framing structure of claim 11 wherein the first and second clamping members each comprise a mounting segment and a clamping segment extending substantially perpendicular to the mounting segment, the mounting segments of the first and second clamping member being mounted to the side mounting portions of the first and second mounting members, respectively, each of the side mounting portions defining a first pair of upper and lower apertures disposed on a first side of the mounting segment and a second pair of upper and lower apertures disposed on a second side of the mounting segment and each of the top mounting portions defining a pair of laterally spaced apertures.

13. The framing structure of claim 10 wherein the first and second clamping members each comprise a mounting segment and a clamping segment extending substantially perpendicular to the mounting segment, the mounting segments of the first and second clamping member being mounted to the side mounting portions of the first and second mounting members, respectively, the clamping segments of the first and second clamping members each being longitudinally spaced from the top mounting portions of the first and second mounting members, respectively.

14. The framing structure of claim 10 wherein the clamping segments of the first and second clamping members each define a bore, at least a portion of the clamping segment of the second clamping member being disposed within the bore of the clamping segment of the first clamping member, and the clamping means comprises an engagement member positionable within the bore of the clamping segment of the first clamping member to engage the clamping segment of the second clamping member.

15. The framing structure of claim 14 wherein the clamping means comprises a bolt member having a threaded shaft and an end defining the engagement member, the clamping segment of the first clamping member defines an opening extending transversely into the bore and comprises means for threadably positioning the end of the bolt member within the bore to clamp the clamping segment of the second clamping member therein.

16. The framing structure of claim 15 wherein the bolt member also has a operator extending substantially orthogonally from the threaded shaft.

17. A locking device for use with a concrete framing structure having a plurality of frame panels forming opposed first and second sides, each of the frame panels having a side and a top, the locking device comprising:

a first locking half including a first mounting member and a first clamping member, the first mounting member having a side mounting portion adapted for rigidly mounting to the side of one of the frame panels of the first side of the concrete forming structure and a top mounting portion adapted for mounting to the top of the one of the frame panels of the first side of the concrete forming structure, the first clamping member having a mounting segment and a clamping segment, the mounting segment being mounted to the side mounting portion of the first mounting member;

a second locking half including a second mounting member and a second clamping member, the second mounting member having a side mounting portion adapted for rigidly mounting to the side of one of the frame panels of the second side of the concrete forming structure and a top mounting portion adapted for mounting to the top of the one of the frame panels of the second side of the concrete forming structure, the second clamping member having a mounting segment and a clamping segment, the mounting segment being mounted to the side mounting portion of the second mounting member; and clamping means for clamping the first clamping member to the second clamping member;

wherein the first mounting member is locked at a predetermined distance from the second mounting member.

18. The locking device of claim 17 wherein the clamping means comprises a bolt member having an operator, a threaded shaft and an end, the clamping segments of the first and second clamping members each define a bore, at least a portion of the clamping segment of the second clamping member being disposed within the bore of the clamping segment of the first clamping member, the clamping segment of the first clamping member defines an opening extending transversely into the bore and includes a nut defining a threaded opening which is coaxial with the opening of the clamping segment, the threaded shaft of the bolt member being threadably engaged with the threaded opening of the nut, whereby the end of the bolt member is positionable within the bore of the clamping segment of the first clamping member to engage the clamping segment of the second clamping member.

* * * * *